United States Patent [19]

Lyman

[11] 4,271,618

[45] Jun. 9, 1981

[54] FRAME CONSTRUCTION

[75] Inventor: George F. Lyman, N. Andover, Mass.

[73] Assignee: Data Packaging Corporation, Cambridge, Mass.

[21] Appl. No.: 7,916

[22] Filed: Jan. 31, 1979

[51] Int. Cl.[3] ..... G09F 1/12

[52] U.S. Cl. ..... 40/152

[58] Field of Search ..... 40/10 D, 152, 154, 152.1, 40/605

[56] References Cited

U.S. PATENT DOCUMENTS

| | | | |
|---|---|---|---|
| 716,074 | 12/1902 | Magie | 40/152.1 |
| 1,024,542 | 4/1912 | Wirsing | 40/156 |
| 1,359,659 | 11/1920 | Beans | 40/605 |
| 1,798,564 | 3/1931 | Timberlake | 40/152.1 |
| 2,505,232 | 4/1950 | Crsitiani | 40/152.1 |
| 2,790,258 | 4/1957 | Freshour | 40/605 |
| 2,865,124 | 12/1958 | Mortellito | 40/605 |
| 3,132,432 | 5/1964 | Yee | 40/152.1 |
| 3,142,920 | 8/1964 | Nelson et al. | 40/16 |
| 3,460,282 | 8/1969 | Swirsky | 40/152 |
| 3,517,452 | 6/1970 | Finley | 40/16 X |
| 4,001,987 | 1/1977 | Coulthard | 40/605 |
| 4,161,834 | 7/1979 | Hendricks | 40/152.1 |
| 4,165,572 | 8/1979 | Sussman | 40/152.1 |

*Primary Examiner*—Gene Mancene
*Assistant Examiner*—Wenceslao J. Contreras
*Attorney, Agent, or Firm*—Wolf, Greenfield & Sacks

[57] ABSTRACT

A photograph display stand having two frame assemblies which are hinged together along their adjacent side edges so that one frame assembly may be moved 360° with respect to the other. Each frame assembly is composed of two identical transparent members arranged back to back and through each a photograph may be viewed.

5 Claims, 10 Drawing Figures

FRAME CONSTRUCTION

INTRODUCTION

This invention relates to picture frame constructions and more particularly comprises a new and improved frame assembly suitable for displaying a plurality of pictures. In the preferred embodiment of this invention, two frame assemblies are hinged together along adjacent side edges, and each assembly is capable of pivoting about the hinge a full 360° with respect to the other.

The sales of decorative photograph frames has rapidly expanded in recent years and is now a multi-million dollar industry. A substantial design and development effort has been invested in this industry, and there are now many attractive and innovative frames available. This invention provides a most attractive, yet inexpensive frame construction having substantial advantages over the products presently available.

One important object of this invention is to provide an inexpensive multi-picture frame which completely encloses each of the pictures mounted in it so that they are fully protected.

Another object of this invention is to provide a multipicture frame which is easy to load and unload but from which pictures will not accidentally slip out.

Yet another object of this invention is to provide a multipicture frame having a minimum number of different parts so that a minimum number of molds are required to manufacture the item and inventory requirements are minimized.

In accordance with the preferred embodiment of this invention, two identical picture frames are connected together by a hinge which joins adjacent side edges of the two frames. Each frame is composed of two identical frame members which are arranged back to back, and the members are made of a transparent material so that two pictures may be sandwiched back to back between them and each may be viewed through the panel disposed in front of it.

The hinge connection between the two frames acts as a foot for the two frames, and similar feet are mounted on the other sides of the frames and cooperate with the hinge foot so as to provide a stable platform for the unit on a horizontal surface. The unit may be readily assembled by ultrasonically welding the two members of each frame together with the hinge and feet in the proper position. When welded together, the members capture the hinge and feet in position so that they may not thereafter be removed.

These and other objects and features of this invention will be better understood and appreciated from the following detailed description of one embodiment thereof, selected for purposes of illustration and shown in the accompanying drawing.

BRIEF FIGURE DESCRIPTION

DETAILED DESCRIPTION

Figure 1:
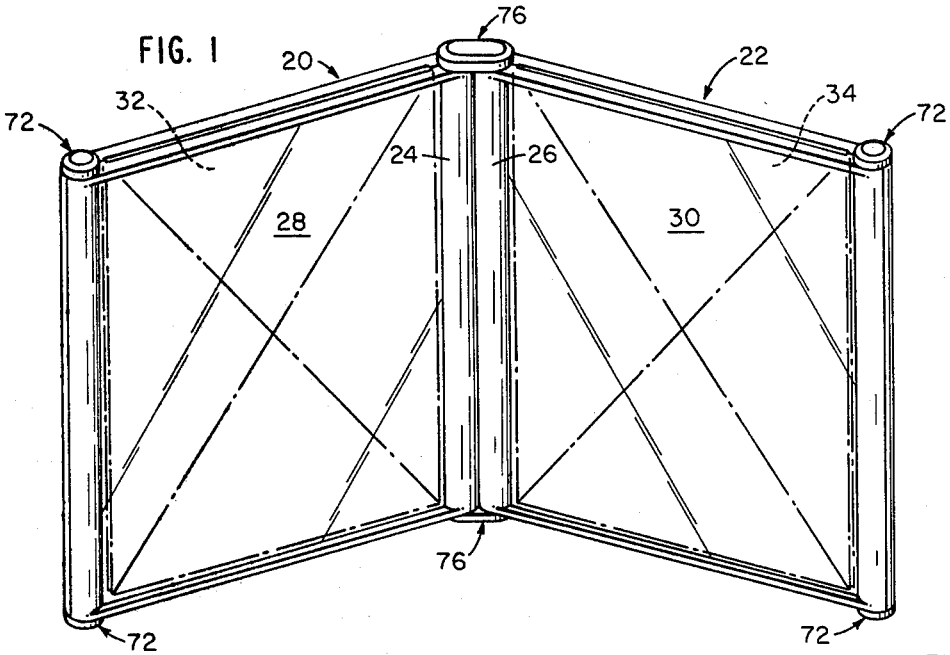
FIG. 1 is a perspective view of a double picture frame assembly constructed in accordance with this invention.

The picture display stand shown in FIG. 1 includes two separate picture frame assemblies 20 and 22 hinged together along their respective side edges 24 and 26 so that each may be turned 360° with respect to the other. Thus, the unit shown in FIG. 1 can be folded so that the front face 28 of frame 20 may lie directly against the front face 30 of frame 22, and the unit may also be folded in the opposite direction so that the back faces 32 and 34 respectively may also lie face to face.

Figure 2:
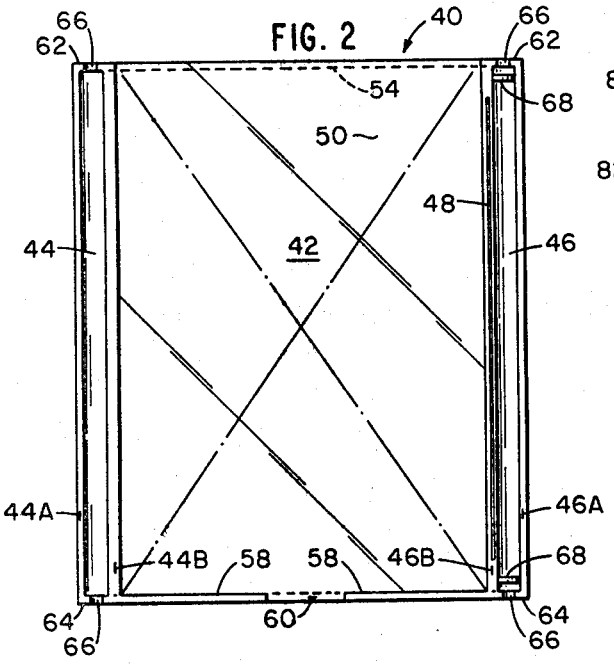
FIG. 2 is an elevation view of one frame member, four of which are used in the unit shown in FIG. 1.

The two frame assemblies 20 and 22 are identical, and only one is described. The various parts and the manner of constructing the frame assembly 20 is shown in detail in FIGS. 2 to 10. In FIG. 2, one frame member 40 is shown, molded of a transparent plastic material such as acrylic having a very high degree of clarity. The member 40 has a main panel 42 through which one picture in the assembly 20 is viewed, and along the sides semi-cylindrical troughs or columns 44 and 45 are formed, both open in the same direction, that is, one the same side of panel 42. As viewed in FIG. 2, the semi-cylindrical troughs are open in a direction above the plane of the paper.

Trough 44 is defined in part by a pair of parallel narrow surfaces 44A and 44B which lie on the sides of the open face of semi-cylindrical trough 44, and similar surfaces 46A and 46B are formed along the side of trough 46. A welding bead 48 is provided on the surface 46B to secure two such members 40 together as is explained in greater detail below.

For purposes of clarity, in the remainder of this description, the side 50 of panel 42 facing in the same direction as the open side of the troughs 44 and 46 will be referred to as the inner face of panel 42, and the opposite side 52 will be referred to as the outer or front face.

Figure 3:
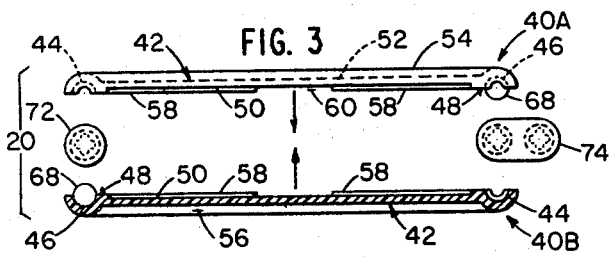
FIG. 3 is an exploded top view, partly in section, of one the two frame assemblies of the unit shown in FIG. 1.

A flange 54 is integrally molded along the upper edge of panel 42 on its front face 52, and a similar flange 56 is molded along the bottom edge of face 52 of panel 42. These flanges cooperate with the troughs 44 and 46 to form a frame for each frame assembly. Along the lower edge of panel 42 on the inner face 50 is an interrupted shoulder 58. In FIGS. 2 and 3 the interruption of the shoulder 58 is clearly shown at 60. The ends of the troughs 44 and 46 are partially closed by walls 62 and 64 although small openings 66 are provided in the walls for purposes which will be made clear presently. The frame member 40 is completed by a pair of alignment disks 68 disposed in the trough 46.

Figure 4:
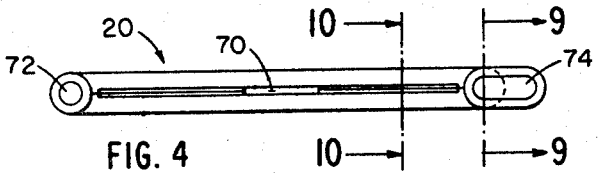
FIG. 4 is a top plan view showing the manner in which the elements of FIG. 3 are assembled.
Figure 5:
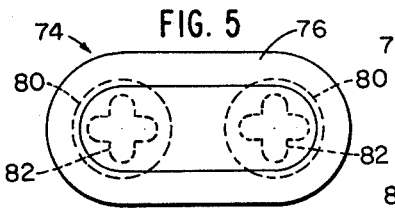
FIGS. 5 and 6 are top and side views, respectively, of one of the two hinge links used in the construction of the unit shown in FIG. 1.
Figure 6:
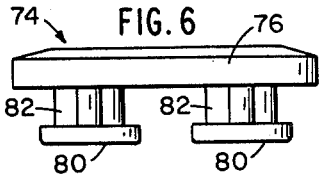
Figure 7:
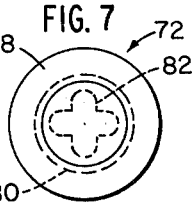
FIGS. 7 and 8 are top and side views respectively of one of four such pegs used in the assembly of the unit shown in FIG. 1.
Figure 8:
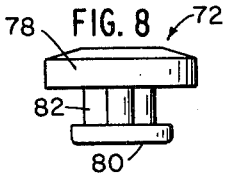
Figure 9:
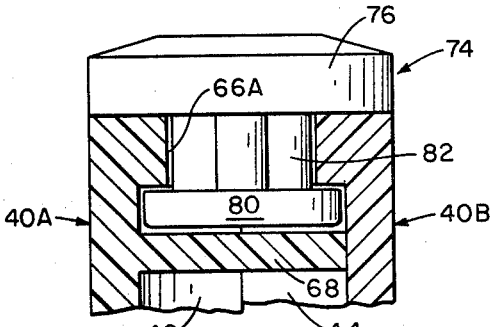
FIGS. 9 and 10 are cross sectional views taken along the corresponding section lines in FIG. 4.
Figure 10:
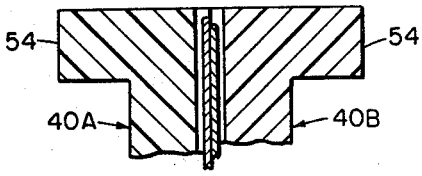

As is evident in FIGS. 3 and 4, the frame assembly 20 is composed of two identical frame members 40 disposed with their inner faces 50 facing one another. When the two frame members 40 are arranged in that fashion, a welding bead 48 is provided along the inner side of each column or cylinder defined by the two facing semi-cylindrical troughs, and by ultrasonic welding, the two members 40 may permanently be secured together. By the use of a jig, the bottom edges of the two members 40 may be vertically aligned with one another, and the alignment disks 68 may be used to orient the two members in proper relationship in a horizontal direction. Thus, as viewed in FIG. 3, when the two members 40 are placed in registration with one another, the alignment disks 68 on frame member 40A align themselves with the trough 44 in member 40B. Similarly, on the other side of the frame member, the disks 68 on member 40B register with the trough 44 in member 40A.

When the two members are brought together in face to face relationship, the surfaces 44A and 46A of the respective members as well as the surfaces 44B and 46B of the members register with one another and by means of the beads 48 the entire assembly is ultrasonically welded. The interrupted shoulders 58 along the bottom edge of each frame member 40 engage one another but provide a slot 70 in the middle of the bottom edge of the frame assembly as shown in FIG. 4. When the frame members are assembled in that fashion, the panels 42 are spaced apart slightly, a sufficient distance to receive a pair of photographs. Because there is no shoulder along the upper edge of the frame assembly between the panels 42, the pictures may be readily slipped between the two faces 50 of the members, but the shoulders 58 at the bottom of the frame assembly prevent the pictures from falling out. On the other hand, the slot 70 formed by the interruptions 60 in the shoulders 58 enables a thin implement to be inserted in the space between the panels so as to eject pictures in the frame assembly when desired.

The pegs 72 and hinge links 74 shown in detail in FIGS. 5 to 8 complete the assembly. The hinge link 74 is essentially two pegs 72 integrally connected by a large foot plate 76. The like parts of the hinge link and peg have been given the same reference characters, and the hinge link is not separately described. The pegs 72 include a foot 78 and circular flange 80 connected by a collar 82 which is spoked rather than being circular in cross section principally for convenience in molding. The major diameter of collar 82 is very slightly smaller than the diameter of the opening 66A formed by the two semi-circular openings 66 at each end of each column 44 and 46. The button 79 is chamfered about is periphery. As mentioned above, the hinge link 74 is essentially two pegs 72 and consequently it includes circular plates 80 and collars 82 identical to those in the peg. The button 76, however, is substantially twice as large as the button 78, but it too includes a chamfered edge.

When the two members 40 are assembled together as viewed in FIGS. 2–4 to form frame assembly 20, pegs 72 are inserted at each end of the left column with the buttons 78 on the outside beyond the column, the plates 80 inside the column, and the collars 82 extending through the openings 66A. A peg is mounted both at the top and at the bottom of that column. On the other side of the frame assembly 20, hinge links 74 are mounted with their plates 80 disposed in the column and the buttons 76 disposed beyond the column ends. Again, a hinge link is used both at the top and at the bottom of the assembly. When the two members 40 are ultrasonically welded together along the beads 48, the pegs and hinge links are permanently anchored in place. Obviously when a second frame assembly is secured to the other half of the hinge link 74, the two assemblies are permanently hinged together and the frames are provided with complete freedom of movement through 360°. The axes of the collars 82 on the hinge links are spaced apart a sufficient distance so that the adjacent columns on the sides of the frames do not interfere with one another and impede the pivotal movement of the frames on the hinge links.

The buttons 76 and 78 on the ends of the columns serve as feet to support the unit composed of the two frame assemblies on a horizontal surface. Because they are employed at both ends of the columns and there is not otherwise formed a top or bottom for the unit, the unit may be inverted and stood on the other horizontal edge. Thus the unit may be folded with either faces of the frames facing out, and they may stand on either end.

From the foregoing description the manner in which the frame assembly is constructed and its various advantages will be apparent. Only three different molds are required to manufacture all of the plastic components of the frame. The troughs formed along the sides impart a classical look to the frames, and pegs and hinge links of contrasting color may be used for decorative purposes. The pegs and hinge links may also be made of a different material to enhance the design.

While in the foregoing description the invention has been described as composed of two frame assemblies, obviously the invention may be made to include different numbers of frame assemblies. For example, three such assemblies may be attached in a row, and the central assembly would be attached on each side by the hinge links to the outside assemblies. With this arrangement the three could be closed in face to face relation in the same fashion as the two assemblies described and shown.

Because numerous modifications may be made of this invention without departing from its spirit, it is not intended to limit the scope of the invention to the single embodiment illustrated and described. Rather, the scope of the invention is to be determined by the appended claims and their eqivalents.

What is claimed is:

1. The picture frame comprising:

a pair of transparent plastic frame members, each of said members having a vertical panel and vertically extending semi-cylindrical grooves along the vertical edges of the panel, and both grooves facing in the same direction, each member also having a horizontal flange along the bottom edge of the panel and extending in the same direction as the open side of the grooves, means assembling the two members in back to back relationship with the flanges on the bottom edges of the panels and the margins of the grooves engaging one another and spacing the panels slightly so that a pair of back to back pictures can be placed between the panels so as to be viewed through the panels and be supported on the flanges, said semi-cylindrical grooves being aligned with one another so as to form hollow columns on each vertical side of the assembled frame, a peg registering with, extending out and closing the lower end of each column, said pegs forming feet to support the frame on a horizontal surface, a second pair of frame members identical to the first recited pair, and secured together and having pegs like those in the first pair, and means securing one of the pegs on one pair of frame members to a peg on the other pair enabling the assembled frames to pivot 360 degrees with respect to one another.

2. A picture frame as defined in claim 1 further characterized by said pegs being molded plastic and a flange formed on the upper end of each peg and retaining the pegs in the columns.

3. A photograph display stand comprising:

a pair of frame assemblies, each of the assemblies including two spaced apart transparent panels through both of which a photograph may be viewed, semi-cylindrical columns along the vertical side edges of each panel and cooperating with the opposite semi-cylindrical columns to form cylindrical columns along the side edges of each of the frame assemblies, links anchored in the top and bottom of one side column of each frame assembly and hingedly connecting the assemblies together and permitting 360° of relative rotation of one assembly with respect to the other, and pegs anchored in the top and bottom of the other side column of each frame assembly, the pegs in the bottoms of the columns and the link in the bottom of the other columns cooperating to form feet to stand the display on a horizontal surface.

4. A picture frame as defined in claim 2 further characterized by a slot between the flanges for inserting an implement between the panels to remove a picture frame between the panels.

5. A picture frame as defined in claim 1 further characterized by means provided in one of the semi-cylindrical grooves of each frame member for aligning the members when they are placed back to back to form the completed frame.

* * * * *